US005218921A

United States Patent [19]

Malcolm

[11] Patent Number: 5,218,921

[45] Date of Patent: Jun. 15, 1993

[54] AIRCRAFT CARRIER

[76] Inventor: Anthony Malcolm, 888 Pavee Court, 6 Soi Chumnarn-auksorn, Phahol Yothin Soi 9, Phahol Yothin Road, Bangkok 10400, Thailand

[21] Appl. No.: 741,451

[22] PCT Filed: Feb. 13, 1990

[86] PCT No.: PCT/AU90/00053

§ 371 Date: Aug. 13, 1991

§ 102(e) Date: Aug. 13, 1991

[87] PCT Pub. No.: WO90/09311

PCT Pub. Date: Aug. 23, 1990

[30] Foreign Application Priority Data

Feb. 13, 1989 [AU] Australia ..... PJ2690

[51] Int. Cl.[5] ..... B63B 35/50

[52] U.S. Cl. ..... 114/261

[58] Field of Search ..... 114/261, 262, 258

[56] References Cited

U.S. PATENT DOCUMENTS

| | | | |
|---|---|---|---|
| 2,349,930 | 5/1944 | Atkinson | 114/43.5 |
| 2,381,583 | 8/1945 | Fechtenberg | 114/43.5 |
| 2,405,115 | 8/1946 | Creed | 114/13.5 |
| 2,807,429 | 9/1957 | Hawkins, Jr. et al. | 114/261 X |
| 3,000,343 | 9/1961 | Winter | 114/43.5 |
| 3,191,566 | 6/1965 | Wilken et al. | 114/261 |
| 3,785,316 | 1/1974 | Leming et al. | 114/43.5 |
| 4,325,317 | 4/1982 | Wifford | 114/261 |
| 4,327,784 | 5/1982 | Denniston | 114/261 X |

FOREIGN PATENT DOCUMENTS

| | | | |
|---|---|---|---|
| 824885 | 2/1938 | France | 114/261 |

*Primary Examiner*—Sherman Basinger
*Attorney, Agent, or Firm*—Foley & Lardner

[57] ABSTRACT

A vessel able to deploy V/STOL aircraft includes: a hull, a main deck with forward and aft exposed sections and an intermediate section comprising a tenth to half the main deck; on the forward, intermediate and perhaps aft sections a take-off runway with a ski jump; a hangar straddling the intermediate section and its runway portion and having walls supporting an upper deck on which functional items are located; pads on the forward and/or aft sections; and an aft section area where aircraft park when others launch through the hangar.

5 Claims, 2 Drawing Sheets

FIG. 1
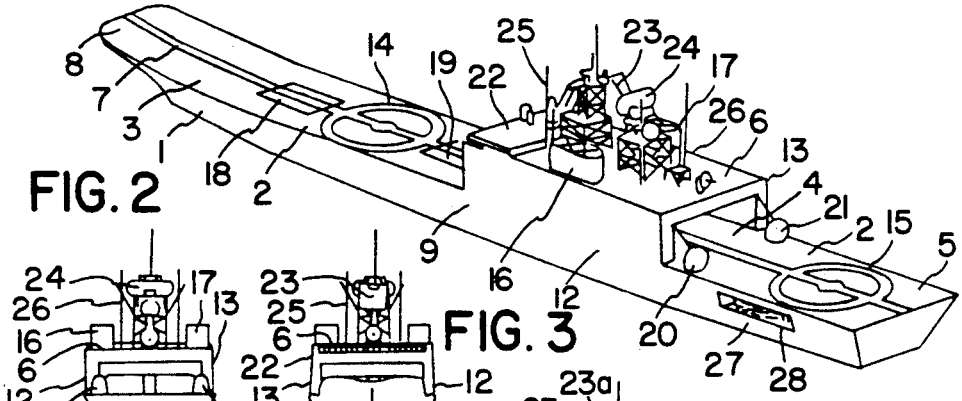
FIG. 2
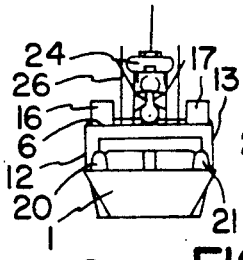
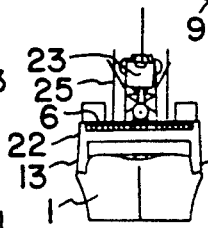
FIG. 3
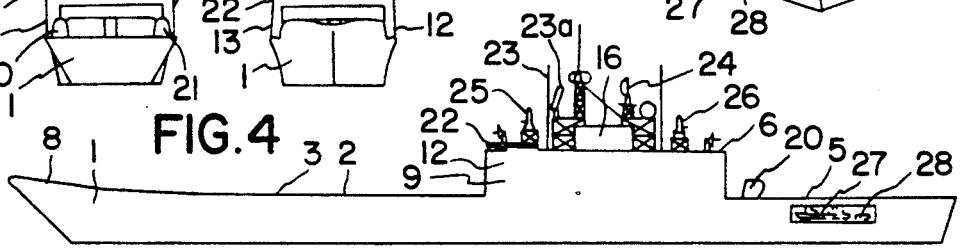
FIG. 4
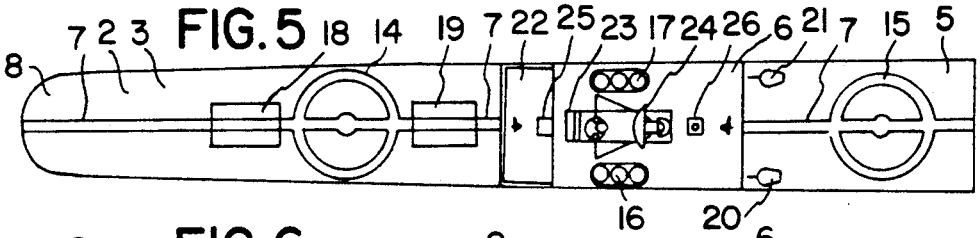
FIG. 5
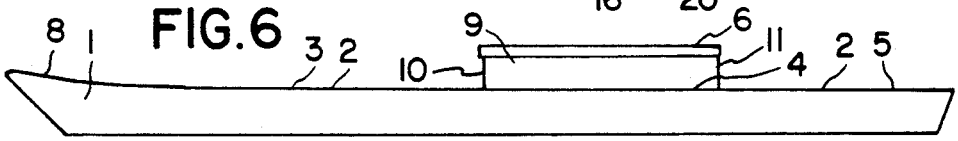
FIG. 6
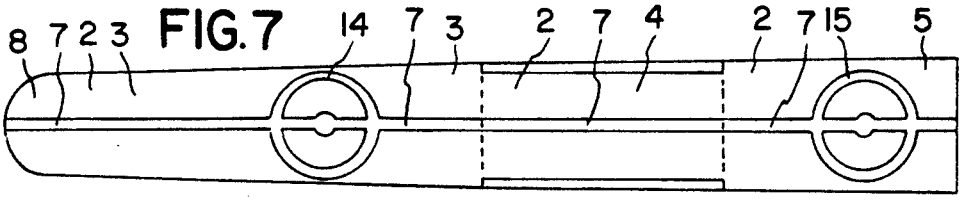
FIG. 7
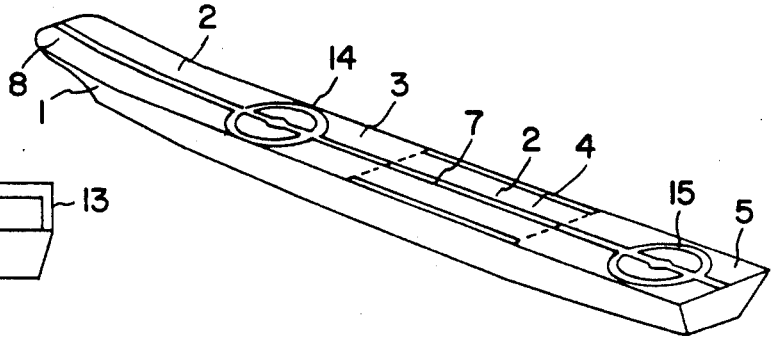
FIG. 8
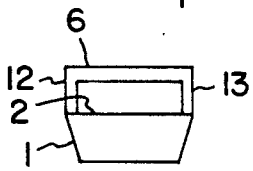
FIG. 9

29
30

34
36
33
31
35
32
37

38
39

42
40
41
43
44
45

46

AIRCRAFT CARRIER

The technical field to which this invention relates is that of aircraft-carrying ships. This invention allows V/STOL aircraft operating in their most capable horizontal-launching mode to be deployed at sea more widely and economically than at present by allowing their deployment on cruisers, destroyers, assault ships and support ships that currently cannot deploy them, in greater numbers on aircraft carriers the size of the current smaller carriers, on small carriers smaller than any current carriers, and on more versatile carriers with unconventional hull types. This is possible because the invention is a vessel with a novel combination of aircraft-related features, a combination that is cheap, fits compactly on a single deck, requires minimum use of mechanery, requires development of no novel construction or flight operation techniques, and that permits easy adaptation into a form allowing the vessel to be fitted as one of the above vessel types.

TERMINOLOGY

The following terms hereinafter have the following meanings.

"vessel" is a waterborne or amphibious ship, vessel or craft.

"hull and propulsive system" is the hull or equivalent and the means of propulsion of a vessel.

"CTOL aircraft" are fixed-wing aircraft like the McDonnell Douglas F/A-18 which launch and land horizontally in the conventional manner on a long runway or on a medium-length runway if assisted by catapults and arresters.

"STOL aircraft" are fixed-wing aircraft that launch and land unassisted horizontally on a short runway.

"V/STOL aircraft" are fixed-wing aircraft like the British Aerospace Harrier that can launch and land unassisted both horizontally on a short runway and vertically.

"STOVL aircraft" are V/STOL aircraft when their manner of operation is to usually launch horizontally and to land vertically.

"V/STOL-as-VTOL aircraft" are V/STOL aircraft when their only manner of operation is to launch and land vertically.

"VTOL aircraft" are V/STOL-as-VTOL aircraft or aircraft such as helicopters which can only launch and land vertically.

"aircraft" are CTOL, STOL, STOVL or VTOL aircraft.

"take-off runway" is a runway on a vessel aligned approximately in the fore and aft direction and having unobstructed air space forward of its forward end so that CTOL, STOL and/or STOVL aircraft can launch from it.

"catapult" is the device usually called that embedded in a take-off runway and used on vessels to assist CTOL aircraft launching.

"ski jump" is the ramp usually called that located at the forward end of a take-off runway and inclined upward in the forward direction and used on vessels to assist STOVL aircraft launching.

"landing runway" is a runway on a vessel aligned approximately in the fore and aft direction and having unobstructed air space above and abaft it so that CTOL and/or STOL aircraft can land upon it; in this specification, even if a such a runway is also a take-off runway, a landing runway will still be described as existing.

"arresters" are the wires and nets usually called that located on a landing runway and used on vessels to assist CTOL aircraft landing.

"runway" is a take-off runway or a landing runway.

"pad" is a take-off or landing pad on a vessel, this being a level area of open deck and having unobstructed air space around it so that VTOL aircraft can launch and/or land upon it; in this specification, even if such a pad is no more than a section of a runway suitable for the launching and/or landing of VTOL aircraft, a pad will still be described as existing.

"draw-down device" is the device usually called that located on a pad and used on vessels to assist VTOL aircraft landing.

"parking area" is a level area of open deck on a vessel where aircraft can be temporarily parked prior to launching or when their removal from a hangar is required; in this specification, even if such an area is no more than a suitable part of a runway or pad, a parking area will still be described as existing.

"hangar" is the structure usually called that on a vessel, this allowing the accommodation of aircraft; in this specification, even if such a structure is no more than a sheltered area, deck, tunnel or passage into which aircraft can move and in which they can park and be sheltered, it will be described as a hangar.

"lift" is a lift for transporting aircraft between decks, the term here not referring to lifts not for transporting aircraft.

"CTOL" vessel is a vessel with a take-off runway, a landing runway, a catapult, arresters and a pad.

"STOL" vessel is a vessel with a take-off runway, a landing runway, and a pad.

"STOVL" vessel is a vessel with a take-off runway and a pad.

"VTOL" vessel is a vessel which can only deploy VTOL aircraft.

"carrier" is a vessel a prime role of which is operating aircraft.

"other-role" vessel is a vessel that is not a carrier.

BACKGROUND TO THE INVENTION

Known CTOL and STOL carriers share a common configuration: a hangar enclosed within a hull, a large flight deck on the hangar roof, take-off runway/s, landing runway/s and pad/s on that flight deck, lifts connecting the hangar and flight decks, and a superstructure off to one side of the flight deck. CTOL carriers such as the USS Nimitz have catapults, arresters and, usually, several runways, some angled. STOL carriers such as HMS Invincible usually have a single through runway serving as take-off runway, landing runway and pad; they usually also have a ski jump because in practice they only operate STOVL and VTOL aircraft. Some 1930s carriers also had an additional take-off runway located on the hangar deck before the hangar, the rear portion of this runway being enclosed under the forward part of the main flight deck. A modern version of this type up-dated with catapults, ski jumps, arresters, etc. for use by newer aircraft and an "assembly line" system within a large hangar for fast landing, servicing and relaunching of large numbers of aircraft has been disclosed in U.S. Pat. No. 4,325,317. Apart from the above vessels, another carrier is known, this being a STOVL vessel without a landing runway: a large container ship on which containers stacked before the superstructure form a flight deck with a take-off runway, a pad and a ski jump. A STOVL vessel is an adequate carrier because even STOL vessels in practice only deploy STOVL and VTOL aircraft. VTOL carriers are also known: some such as the French Jeanne d'Arc configured with a large hangar aft, a large pad atop it, and lifts connecting those decks; a carrier for V/STOL-as-VTOL aircraft with no pad but using a device developed by British Aerospace to release and recover hovering V/STOL-as-VTOL aircraft has also been proposed. Most VTOL vessels are not carriers but are other-role ships, usually small, configured in one of two ways: with a hangar on the main deck abaft the superstructure and a pad abaft the hangar; with only an aft pad. In contrast, CTOL, STOL and STOVL vessels are all large and, effectively, all carriers; this because all built or proposed have at least one of the following: a fore and aft flight deck with a superstructure beside it and therefore a wide beam; a heavy flight deck on the hangar roof and therefore a hangar of a construction sturdy enough to support it and a large hull to offset the resulting top-heaviness; a hangar enclosed in the hull and therefore a hull of wide beam; a hangar-deck with a take-off runway, that deck therefore being high above the waves; an in-line take-off runway and hangar or in-line take-off runway and superstructure and therefore a long hull; complex and/or heavy machinery like catapults, arresters and, especially, lifts. Being large and expensive, these ships have to justify their purchase by having one or more of the following that make them even larger and/or more expensive: permanent air groups as large as the ships can carry and which, because the ships are large, are quite large; full and comprehensive servicing and maintenance facilities; large fuel and weapons storage capacity; an all-weather capability and therefore a high-profile but still stable and thus large hull. This overall expense means a number of other-role ships are not built. Carriers justify their expense and this forgoing of other ships with their air groups' potency; their expense, the forgoing of other ships and this potency in turn means carriers are both unriskable and a prime target to an enemy and therefore they are either or both: armed and/or armoured and therefore even larger and more costly; provided permanently with heavily-armed escorts—making them more attractive as targets as elimination of a carrier leaves its escorts without air cover. Carriers being unriskable, such weapons, whether fitted to carriers or to escorts, are largely restricted to defense as carriers must stay as far as possible from an enemy; their air groups effectively being the sole offensive weapon. All this in effect means carriers are single-role vessels: even if as heavily armed as a cruiser, they will not undertake tasks a more expendable cruiser can undertake. A balanced carrier navy, unless it is certain it will only go to war accompanied by allies, will have at least two of these expensive ships, their expensive air groups, their escorts, and other ships for independent operations. Such a navy with CTOL carriers can overwhelm any non-carrier navy and most land-based air forces. STOL or STOVL carrier navies are superior to navies not so equipped. These are the advantages of carriers; the disadvantage is expense, an expense that cannot be reduced because vessels with a runway above a hangar or a runway before a hangar, as noted, must be large. STOL and STOVL carriers have another disadvantage: because they are small, their air groups are too small to ensure protection against land-based CTOL aircraft. Few nations can afford the balanced two-carrier navies described so most rely on fighting ship navies comprising destroyers, frigates, light frigates, corvettes and/or fast attack craft and any requisite support and assault ships. Unlike a carrier navy, such navies have no minimum size or expense. The larger ones comprise destroyers, frigates, assault and support ships, these today generally being (helicopter-deploying) VTOL vessels with a hangar and pad on the main desk as described above. The combination can be fitted to them because it is compact and unintrusive: the pad is small: the size of the air group determines the hangar's size and air groups being small, so is the hangar; the hangar supports no flight deck on its roof so the hangar is of light construction; the hangar roof, the decks below, most of the main deck and most of the air space around the ship are not intruded upon by aircraft facilities or operations so the equipment for the ships' other roles is easily fitted. Among these ships' advantages are: there is no minimum size for their air groups, indeed air groups can even be not deployed as ships with the hangar and pad are hardly more costly than ones without them; the VTOL capability need not be an all-weather or full-maintenance one so savings in vessel size and equipment are possible; fleets of VTOL destroyers and frigates can be dispersed or concentrated at will, when dispersed each vessel has its own air group, when concentrated the force has no prime target at its core and its VTOL capability is not eliminated till the last ship is sunk; no ship is unriskable and so they can be deployed forward where all their weapons can be used. The deficiency of such navies is their lack of fixed-wing aircraft. V/STOL-as-VTOL aircraft can be deployed on larger VTOL ships but the aircraft's limited range means they are not sufficiently superior to ship-launched missiles to persuade many navies to purchase them.

OBJECTIVES OF THE INVENTION

The objective of the present invention is to provide to both carrier navies and fighting ship navies the above-mentioned advantages of the other kind of navy while remedying the deficiencies of each, and do this by: increasing the utility of carriers by increasing the number of STOVL aircraft deployable on carriers as large as present small STOL carriers; reducing the size and cost of STOVL carriers to make them affordable by small navies and/or to allow their purchase in numbers that render a carrier's loss less catastrophic; allowing carriers with versatile unconventional hulls to be constructed; and, most importantly, providing a STOVL capability to the other-role ships of both navies. These lead to more specific objectives: to adapt a STOL carrier so it can accommodate more aircraft; to develop a combination of take-off runway, pad and hangar light enough to fit on small or unconventional hulls; to provide other-role ships with a take-off runway, hangar and pad combination of an unintrusiveness similar to their VTOL capabilities;' to do the above while keeping development costs low and, where applicable, avoiding use of costly machinery or unproven technology and using existing vessel designs.

OUTLINE OF THE INVENTION

The vessel of present invention achieves these objectives by being a vessel with a compact STOVL combination of take-off runway, hangar and pad and a vessel adaptable into the above forms: it comprising: a hull and propulsive system; a main deck divided into an exposed forward section, an intermediate section comprising about a tenth to a half the main deck, and an aft exposed section; an upper deck on which superstructure items are located; a take-off runway extending along most or all the main deck and with a ski jump; a hangar which straddles the intermediate deck section and its runway portion, this hangar being open at both ends and its roof being the upper deck and its walls containing items like uptakes to the funnels; pads located on the forward and/or aft deck sections and on any runway portions there; and parking areas located on the aft deck section and perhaps elsewhere and on any pads or runway portions there. Adapting this vessel into an other-role ship is possible because such ships' main decks are half to three fourths exposed and have missile launchers, guns, cranes, gantries or the like and a helicopter hangar and pad on the exposed sections, on this vessel those deck items are placed beside, abaft, above or straddling the runway while the hangar and pad are incorporated; the superstructure occupies the other fourth to half of such ships' decks, on this vessel it is raised, funnel uptakes leading to it being located in the hangar walls; the deck of this vessel is roughly the size of such ships' present decks and its hangar and superstructure not top-heavy because they are of light construction and, because the air group to be housed in the hangar is small, no larger than such ships' present superstructures. As this vessel's other roles justify its purchase, the STOVL capability may not be a permanent-deployment, major-maintenance or all-weather capability, the high freeboard, broad deck and heavy equipment these require only being provided to an extent justified by the vessel's and air group's size, cost and role. The hangar being provided with only minimal fittings, STOVL aircraft are able to launch through it when accommodated aircraft are relocated to the aft parking area. This vessel can also be adapted into the mentioned carriers with very small or unconventional hulls, they differing from the vessel just described by having no other-role equipment. This vessel can be adapted as the mentioned carrier of current STOL carrier size by superimposing its light main-deck hangar onto the flight deck of a present STOL carrier and shifting that carrier's superstructure to this vessel's hangar roof. Since this vessel is intended for adaptation into a diverse range of vessels and especially since every naval ship built is customised with special features to meet a particular navy's needs, a number of alternatives are possible: a runway extending right to the stern or just to the hangar's rear; pads before the hangar, abaft it or both; a fixed ski jump or one that can be used as a landing ship vehicle ramp; the fitting or not of hangar doors (an emergency-only capability may not justify their expense); additional runways; additional pads or parking areas on deck extensions or, if a hangar is long, on the hangar roof; on a large ship, additional hangars below; rails or grooves to stabilise or guide launching aircraft. This invention advances the art by cheaply allowing other-role ships to be STOVL vessels, by cheaply increasing hangar space for aircraft on small STOL carriers (and making them STOVL carriers) and by making unconventional-hull or small carriers feasible. It differs from current art in its use of the runway-through-hangar arrangement for the purpose of reducing the intrusiveness and size needed for a STOVL capability: this by eliminating the runway before or upon a hangar, combining take-off runway and hangar, and reducing hangar size, weight and machinery.

LIST OF ILLUSTRATIONS

FIG. 1 is a view from a high point to the left and rear of a vessel embodying the invention and showing, like all the following, the vessel only above the waterline, and, like all the following except FIG. 6, hangar doors open.

FIGS. 2 to 5 are views from behind, in front, the left and above respectively of the above vessel and drawn, like all the following, to a scale 0.85 of FIG. 1.

FIG. 6 is a view from the left of a vertical section along the fore and aft centreline of the above vessel without fittings.

FIGS. 7 and 8 are views from above and from a high point to the left and rear respectively of the above vessel without hangar and fittings.

FIG. 9 is a view from behind of a vertical section along a line across the rear end of the hangar of the above vessel without fittings.

DESCRIPTION OF EXAMPLES

Figures 10, 11, 12, 13, 14, 15:
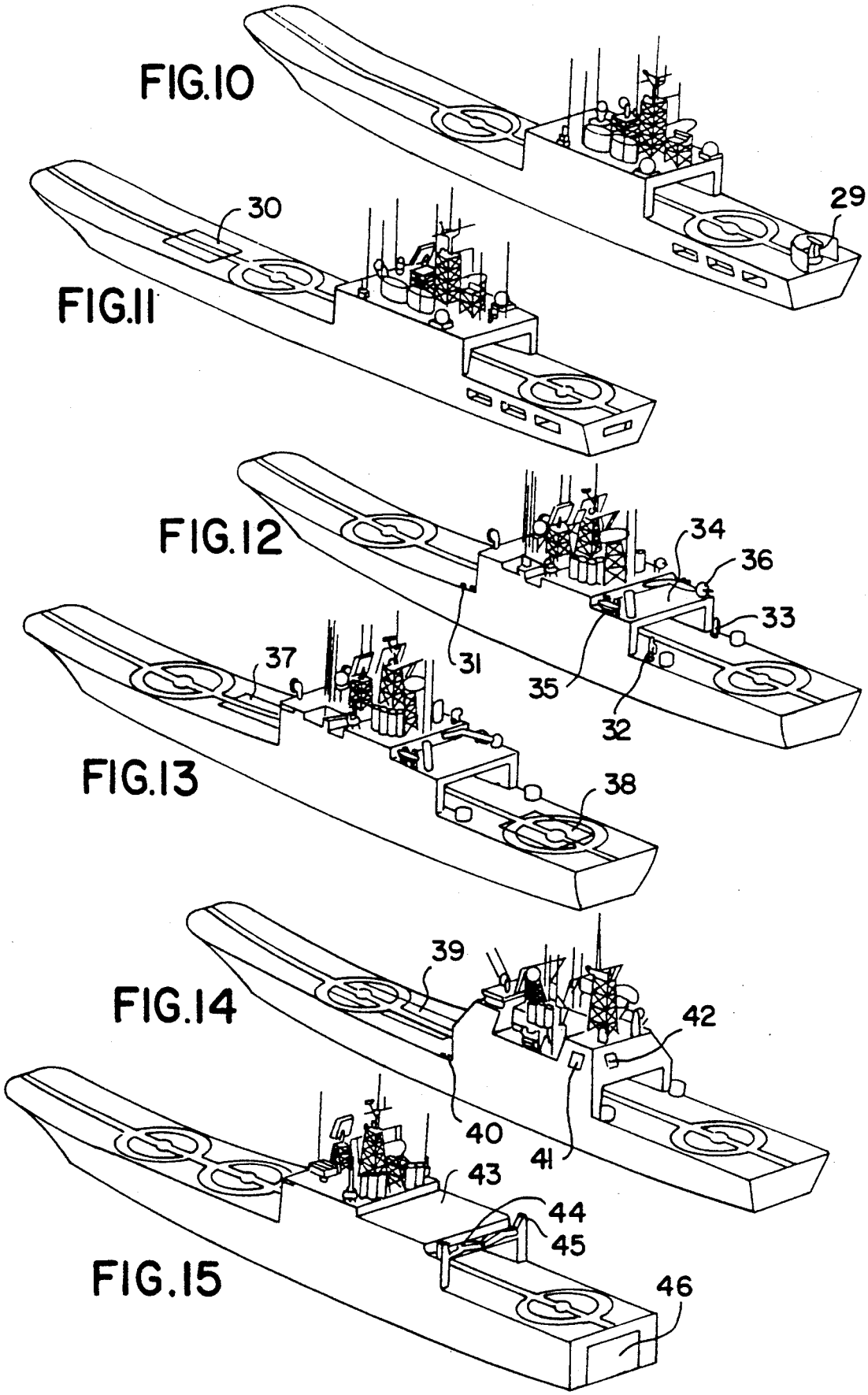
FIGS. 10 to 15 are views from a high point to the left and rear of further vessels embodying the invention.

Several particular embodiments of the invention representing some but by no means all of its possible forms will now be described with reference to the accompanying drawings. The vessel embodying the invention in FIGS. 1 to 9 is adapted as a light cruiser of overall length 175 meters, overall width 24 meters, waterline length 160 meters, waterline width 18 meters. It has a conventional hull 1 and propulsive system; a main deck 2 divided into a forward exposed section 3, an intermediate covered section 4, and an aft exposed section 5; and an upper deck 6. The features providing the vessel's STOVL capability are: a stern-to-bow take-off runway of 175 meters×18.5 meters, the centreline marking of which can be seen 7; a ski jump 8 forming part of the bow; a hangar 9 of interior dimensions 45 meters×18.5 meters straddling and covering the said intermediate deck section, with opening doors 10, 11, and walls 12, 13 supporting a roof which is the upper deck 6; before and abaft the hangar are pads, the markings of which 14, 15 can be seen; while much of the said aft deck section 5 constitutes a parking area. The vessel is of a size to deploy three to four STOVL aircraft and three to five helicopters. The aircraft's manner of operation is as follows. They are accommodated in hangar 9. When helicopters are to launch or when STOVL aircraft are to launch vertically with a light load, they move to and launch from pads 14, 15. When a somewhat heavier load is required, STOVL aircraft accelerate forward from within hangar 9, along the runway portion on the said forward deck section 3 and take to the air from ski jump 8. When a maximum load is required, aircraft accommodated in the hangar move to the parking area on the said aft deck section 5 and park there with their tails overhanging the sides or stern of the vessel, the area being adequate for this and crowding not being a problem as the air group is small (aircraft can also temporarily take the air). STOVL aircraft then accelerate forward along the runway 7 from the said aft deck section 5, into the hangar 9 and along the said intermediate deck section 4 within it, thence along the said forward deck section 3 and take to the air from ski jump 8. Collision with walls 12, 13 is not a major danger as the runway is wide (much wider than HMS Invincible's runway); if a collision occurs, the aircraft are not moving at high speed while in the hangar and the impact will be glancing so normal strengthening of the walls allows them to withstand it. If sea or weather conditions make a collision possible, the aircraft only launch vertically. (Danger from accidents is in any case more than offset by the safety from enemy attack the aircraft provide.) All deployed aircraft land vertically on pads 14, 15. This embodiment has several notable features. Retractable anchoring, servicing and maintenance equipment is fitted in the hangar but cumbersome or obstructive items are absent. Ventilation of jet fumes is provided by the hangar's openness. Uptakes to funnels 16, 17 pass through the hangar walls 12, 13. The vessel is fitted as a cruiser and vertical missile launchers 18, 19 are embedded in the forward deck section 3, heavy guns 20, 21 are fitted on aft deck section 5, a bridge 22 and a full range of electronic systems 23, 24, most 23*a*, and point-defence weapons 25, 26 are located on upper deck 6, boats 27 and torpedo tubes 28 are located on a deck below. FIGS. 10 to 15 illustrate how further aircraft-related or other features can be fitted to other forms of the vessel of present invention. Only significant items are noted and aircraft operate as on the above vessel. FIG. 10 illustrates a destroyer of dimensions overall 174 meters×22 meters, waterline 160 meters×17 meters with an amiable missile launcher 29 at the aft end of the main deck. FIG. 11 illustrates a similar destroyer with a completely unobstructed main deck and an embedded vertical launcher 30. FIG. 12 illustrates a cruiser of 174 m×24 m, 159 m×20 m with torpedo launchers 31, aimable launchers 32, 33 beside the runway and a small helicopter parking area 34 on the hangar roof to which helicopters can be lifted by means of cranes 35, 36 which can also service the launchers 32, 33. FIG. 13 illustrates a hybrid cruiser/carrier of 175 m×24 m, 159 m×20 m with embedded vertical launcher 37 and a belowdecks additional hangar to which aircraft are transported by lifts, one of which is in the hangar and one 38 on the said aft deck section. FIG. 14 illustrates a cruiser for air-defence of 179 m×23 m, 163 m×20 m with vertical launcher 39, a retracting breakwater 40 before the hangar, and fixed-array radars 41, 42. FIG. 15 shows a 180 m×26 m, 165 m×26 m assault ship with a small additional pad and parking area 43 on the hangar roof to which aircraft can be moved by their taking to the air or by means of cranes 44, 45 and a vehicle deck belowdecks which forms an additional hangar and to which access is by ramp, the vessel also having a large docking well 46 aft for landing craft.

It will be appreciated by those skilled in the art that many alterations and modifications to the vessels described above are possible. Thus the vessels may be fitted with at least one of the following arrangements: a retractable breakwater protecting a runway, pad, parking area or hangar; upright barriers on the main deck protecting equipment from damage in the event of aircraft accidents; a draw-down device or a device for launching and/or recovering hovering aircraft; aircraft anchoring equipment; equipment for suspending or moving aircraft so that they do not obstruct launchings and/or landings; a pad or parking area on a protruding deck extension; a groove, guide-rail or rail-and-dolly arrangement for guiding and/or anchoring aircraft; any arrangement commonly used on ships to assist STOVL or VTOL operations.

Another variation envisaged by this invention is the use of a guide-groove formed in the take-off runway for guiding aircraft during launching, on-deck movement or parking, the groove or slot being shaped in section so that its opening at the surface of the runway is relatively narrow, the groove or slot thus being adapted to restrain both the lateral and vertical movement of an aircraft during launching, on-deck movement and/or parking, when the aircraft is provided with a device that fits and runs in the groove or slot.

The hull design and propulsion system of the vessel may be of any suitable type, for example: twin-hulled, multi-hulled or foil-borne, a self-propelled raft, platform or pontoon, an air cushion, surface-effect or wing-in-ground-effect craft, or any other unconventional water-borne or amphibious ship vessel or craft. The ski-jump may be arranged so that it protrudes forward from the bow, being connected to the bow by a hinged rear edge and being movable downwards on the axis of that hinged edge in a manner allowing the ski-jump's forward edge to be brought to rest on a dock or beach, so that vehicles may use it to travel between the main deck and the dock or beach. One or more additional take-off runways may be located on the main deck beside or partially upon the take-off runway, and being as long as or shorter than the take-off runway. One or more arch-like, gantry-like or additional tunnel-like structures may straddle the take-off runway or the additional runways.

The vessel may be provided with one or more capabilities in addition to the STOVL and VTOL capabilities, for example: a medium or heavy gun, a missile launcher or torpedo launcher, located on the main deck beside or abaft a runway, on the upper deck or another deck of the vessel, and/or embedded within the main deck so covered as to allow aircraft to move above it. The missile launcher may be a vertical-launch missile system.

The vessel may also be fitted with one or more of the following items: a gantry, a crane or boom that can be used for functions that give the vessel a capability additional to the aircraft capability, the item being either one also having an aircraft-related function or one not having such a function; a main or below decks hangar characterized for additional use as a troop, vehicle, tank or the like deck; a troop, vehicle, tank or the like deck that is not also a hangar; bow doors; stern doors; a docking well; a hold; a liquid cargo tank; a facility for replenishing other ships.

Since an objective of the present invention is to provide STOVL and VTOL capabilities to another-role ship have the size, and general description of one of the following vessel types and in such a manner that it can function as that type of vessel when STOVL aircraft are not deployed. As illustrated in FIGS. 1 to 12, 14 and 15, such a ship may be a cruiser, a destroyer, an amphibious assault ship, a naval support ship, or a civilian ship with a reserve naval role, or as shown in FIG. 13 a hybrid.

I claim:

1. A vessel, from which STVOL and VTOL aircraft can operate, comprising a continuous main deck, extending in the fore and aft direction for a majority of the length of said vessel, comprising:

an exposed forward section, an intermediate section, and an exposed aft section, wherein said intermediate section is between about one tenth to one half the area of said main deck and one tenth to sixth tenths the length of said main deck;

a take off runway aligned approximately in the stern-to-bow direction located on at least said forward and intermediate sections of said main deck;

a ski jump at the forward end of said runway;

a hangar of tunnel-like construction open at both forward and aft ends straddling said intermediate section and the portion of said runway thereon, said hangar having said walls extending in the fore and aft direction and supporting a roof covering said intermediate section of said main deck;

an upper deck supported upon said side walls on which a bridge, funnel, electronic equipment, masts and weapons are located, said side walls providing access to and services for said upper deck;

at least one pad on one of said sections of said main deck other than said intermediate section; and at least one aircraft parking area located on said exposed aft section of said main deck.

2. A vessel according to claim 1, wherein said take-off runway extends onto said exposed aft section as well as on said exposed forward and said intermediate sections.

3. A vessel according to claim 2, wherein said main deck and said take-off runway extend substantially to the stern of said vessel.

4. A vessel according to claim 1, wherein pads are located on both forward and aft sections.

5. A vessel according to claim 1, wherein said ski jump forms part of the bow of said vessel.

* * * * *